US010140894B2

(12) United States Patent
Woolstenhulme

(10) Patent No.: US 10,140,894 B2
(45) Date of Patent: Nov. 27, 2018

(54) YARD SIGN ANCHOR AND STABILIZER

(71) Applicant: Roger Woolstenhulme, Provo, UT (US)

(72) Inventor: Roger Woolstenhulme, Provo, UT (US)

( * ) Notice: Subject to any disclaimer, the term of this patent is extended or adjusted under 35 U.S.C. 154(b) by 42 days.

(21) Appl. No.: 15/583,580

(22) Filed: May 1, 2017

(65) Prior Publication Data

US 2018/0315354 A1 Nov. 1, 2018

(51) Int. Cl.
*G09F 7/18* (2006.01)

(52) U.S. Cl.
CPC ..... *G09F 7/18* (2013.01); *G09F 2007/1834* (2013.01)

(58) Field of Classification Search
USPC ..... 40/607.1, 607.05, 607.08; 248/536, 545, 248/121, 156, 440.01; 52/155, 156, 700, 52/701, 704, 708, 707
See application file for complete search history.

(56) References Cited

U.S. PATENT DOCUMENTS 758,088 A 4/1904 Mixer
1,598,438 A 8/1926 Hallowell
2,559,106 A 7/1951 Bishop
2,841,902 A 7/1958 Pfundt
3,662,482 A 5/1972 Sarkisian
3,724,145 A * 4/1973 Daniel ..... E04H 12/2215 256/32
4,183,695 A 1/1980 Wilcox
4,258,494 A 3/1981 Borque
4,259,803 A 4/1981 Sittler
4,278,228 A * 7/1981 Rebentisch ..... G09F 15/0056 248/548
4,311,300 A 1/1982 Buerger
4,343,449 A 8/1982 Osthus
4,483,506 A 11/1984 Litwiller
4,685,233 A 8/1987 Hull
4,790,092 A * 12/1988 Farmer ..... G09F 7/18 40/606.19
4,792,258 A 12/1988 Goff
4,910,902 A 3/1990 Anderson
4,923,157 A 5/1990 Belamiza
5,083,390 A 1/1992 Edman
(Continued)

OTHER PUBLICATIONS

U.S. Appl. No. 29/603,839, filed May 12, 2017, Woolstenhulme.
U.S. Appl. No. 29/603,864, filed May 12, 2017, Woolstenhulme.

*Primary Examiner* — Cassandra Davis
(74) *Attorney, Agent, or Firm* — Workman Nydegger

(57) ABSTRACT

Various embodiments of anchor/stabilizers intended for use with yard signs that assist in keeping the yard signs standing perfectly upright (or "plumb") over time. The device is a separate piece that attaches to the upright posts of the yard sign. In one embodiment, the device is formed of an elongate support and a flat metal plate that is welded to an intermediate portion of the elongate support, such that one surface of the plate is co-planar with the exterior surface of the elongate support. The plate has a plurality of holes spaced around its surface to facilitate fastening the device to the outer surface of each of the vertical posts. The anchor/stabilizer can come in a variety of lengths and sizes, depending on the environmental conditions and forces likely to be encountered at a particular installation site.

16 Claims, 10 Drawing Sheets

(56) References Cited

U.S. PATENT DOCUMENTS

| | | | | |
|---|---|---|---|---|
| 5,123,623 | A * | 6/1992 | McNamara | E04H 12/2253 248/156 |
| 5,307,598 | A | 5/1994 | Wet | |
| D353,625 | S | 12/1994 | Thomsen | |
| 5,431,372 | A | 7/1995 | Kostelecky | |
| D361,794 | S | 8/1995 | Oakley | |
| D367,078 | S | 2/1996 | Oakley | |
| 5,737,862 | A | 4/1998 | Cooper | |
| 5,921,035 | A | 7/1999 | Kempf | |
| 5,964,052 | A | 10/1999 | Jepsen | |
| 5,966,892 | A * | 10/1999 | Platt | E04B 1/26 403/386 |
| 6,502,340 | B2 | 1/2003 | Stone | |
| 6,668,474 | B2 | 12/2003 | Winterton | |
| 7,107,714 | B2 | 9/2006 | Evans | |
| 7,175,141 | B2 | 2/2007 | Bolinder | |
| 7,661,213 | B2 | 2/2010 | Gainey | |
| 7,823,348 | B1 | 11/2010 | Leiva | |
| 8,286,925 | B1 | 10/2012 | White | |
| 8,959,813 | B2 | 2/2015 | Denby | |
| 9,016,656 | B2 | 4/2015 | Basconi | |
| 9,340,991 | B2 | 5/2016 | Yandell | |
| 2003/0223807 | A1 * | 12/2003 | Lanphier | E04F 11/1812 403/167 |

* cited by examiner

YARD SIGN ANCHOR AND STABILIZER

BACKGROUND OF THE INVENTION

1. The Field of the Invention

The invention relates to devices for anchoring and stabilizing yard signs and to assist in keeping the yard signs standing upright (or "plumb") over time.

2. The Relevant Technology

The use of temporary or semi-permanent yard signs is quite prevalent, particularly in the fields of commercial and residential real estate (e.g., "For Sale" and "For Lease" signs) as well as other commercial settings. In commercial real estate leasing, such yard signs typically consist of two, spaced apart 4×4 vertical posts planted in the earth, with 2×4 cross members and a flat display surface. Over time, it is quite common for such signs to lean, bend or sag, due to a variety of factors including shifting soil, wind, etc. This can be unsightly and can convey an undesirable impression to the public. In addition, such conditions may also present a safety hazard to persons and property if such conditions are allowed to progress to the point of compromising the overall structural integrity of the sign.

BRIEF SUMMARY OF THE INVENTION

The invention is directed to various embodiments of an anchor and stabilizer intended for use with yard signs that assist in keeping the yard signs standing upright (or "plumb") over time. The device is a separate piece that attaches to the upright posts of the yard sign. In one embodiment, the device is formed of a length of conventional angle iron and a flat metal plate that is welded in the middle of the angle iron, such that one surface of the plate is co-planar with the exterior surface of one leg of the angle iron. The plate has a plurality of holes spaced around its surface to facilitate fastening the device to the outer surface of each of the vertical posts. The anchor/stabilizer can come in a variety of lengths and sizes, depending on the environmental conditions and forces likely to be encountered at a particular installation site.

In another embodiment, the anchor/stabilizer can also be combined with a shield component that helps protect the upright posts of the sign from being damaged by groundskeeping equipment.

Various other embodiments of anchors/stabilizers for use with yard signs are also disclosed herein.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The use of temporary or semi-permanent yard signs is quite prevalent, particularly in the fields of commercial and residential real estate (e.g., "For Sale" and "For Lease" signs) as well as other commercial settings. In commercial real estate leasing, such yard signs typically consist of two, spaced apart 4×4 vertical posts planted in the earth, with 2×4 cross members and a flat display surface. Over time, it is quite common for such signs to lean, bend or sag, due to a variety of factors including shifting soil, wind, etc. This can be unsightly and can convey an undesirable impression to the public. In addition, such conditions may also present a safety hazard to persons and other personal property if such conditions are allowed to progress to the point of compromising the overall structural integrity of the sign.

The invention is directed to various embodiments of sign anchor/stabilizers, which can be attached to the vertical posts of a sign to assist in keeping the standing essentially upright (or "plumb") over time. While the invention is described below in the context of use with various forms of yard signs, it will be readily apparent to those skilled in the art that the invention can be adapted for use with any vertically oriented post, or any other structure or device that incorporates on or more vertical posts, the lower portions of which are placed in holes formed in the ground and supported by earth. While temporary and semi-permanent yard signs may, perhaps, be among a preferred application or field of use for the invention, the following description is intended as one example of an application or environment for use of the invention. Therefore, the scope of the invention should not be construed as being limited to use with yard signs only, but is expressly intended to encompass use with other structures and components thereof.

Figure 1A:
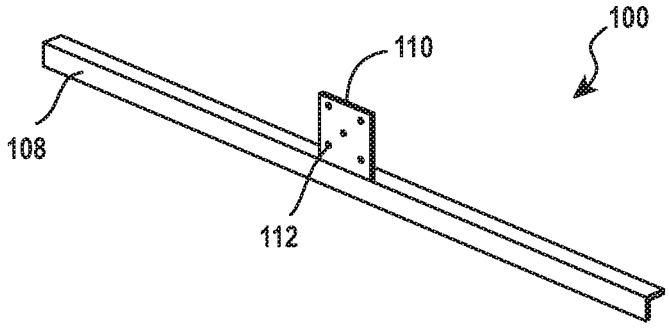
FIG. 1A is a perspective view of one embodiment of a yard sign anchor/stabilizer.
Figure 1B:
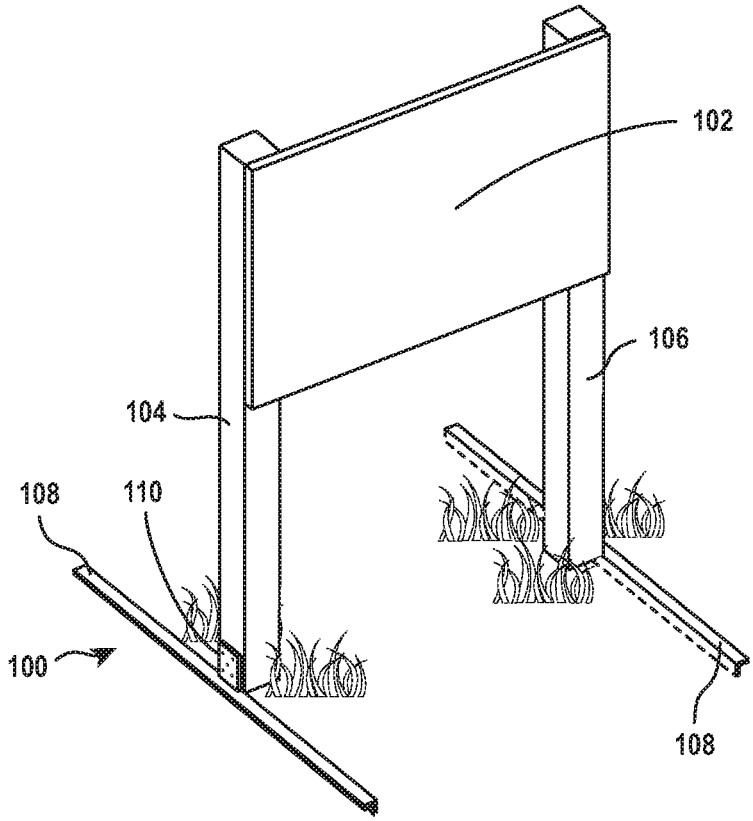
FIG. 1B is a perspective view of a yard sign with two of the yard sign/stabilizers of FIG. 1 installed and attached thereto.
Figure 2A:
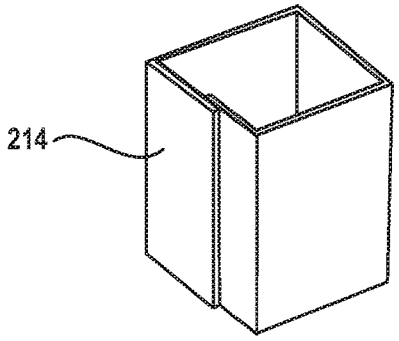
FIG. 2A is a perspective view of one embodiment of a post shield intended for use in combination with a yard sign anchor/stabilizer.
Figure 2B:
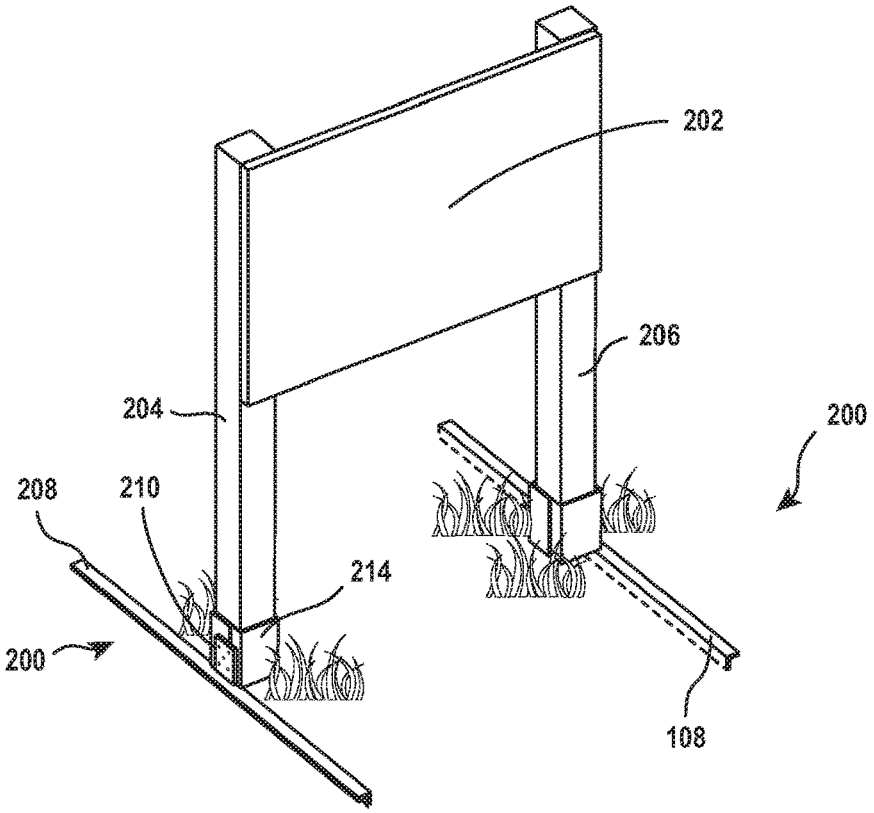
FIG. 2B is a perspective view of a yard sign with a combination of two of the yard sign/stabilizers of FIG. 1 with two of the post shields of FIG. 2A installed and attached thereto.

FIGS. 1 and 2 illustrate one embodiment of an anchor/stabilizer 100, which is intended for use with a larger sign 102 having two upright posts 104 and 106. Anchor/stabilizer 100 can be a separate piece that can be attached to an upright post of the yard sign. The design is quite simple. As shown in FIG. 1, this embodiment of anchor/stabilizer 100 is formed of an elongate support or cross-bar 108 and a mountain plate 110 that is welded to an intermediate portion of the cross-bar 108, such that one surface of the plate 110 is co-planar with one exterior surface of the cross bar 108. The plate 110 has a plurality of holes 112 spaced around its surface to facilitate fastening (with suitable fasteners, such as wood screws, not shown) the device to the outer surface of each of the vertical posts 104 and 106. The anchor/stabilizer 100 can come in a variety of lengths and sizes, depending on the environmental conditions and forces likely to be encountered at a particular installation site.

To install, the sign 102 is constructed and installed in a conventional manner. Typically, the sign is fully assembled off-site (without the anchor/stabilizer attached), but can be constructed on-site as well. Once at the site, holes are dug for the vertical posts 104 and 106, the posts 104 and 106 are placed in the holes and, using a level, the sign is then leveled and plumbed, the holes are backfilled with soil, and the soil compacted around the posts 104 and 106. Then, the anchor/stabilizers 10 are installed as follows. An anchor/stabilizer 100 is placed adjacent the outer-facing surface of each post 104 and 106, with the plate 110 facing and abutting the outer surface of the post (104 or 106) and the plate 110 extending up vertically from the ground, and with the cross-bar 108 directly contacting the ground adjacent to the post (104 or 106). With the plate 110 positioned against the outer surface of the post (104 or 106), it will be appreciated that the anchor/stabilizer 100 will be oriented so that the cross-bar 108 extends in a direction perpendicular to the display surface of the sign 102, thus providing added stability against wind and other exterior forces. The cross-bar 108 is also oriented to conform to the contour of the surrounding ground (e.g., if the ground is sloped, then the cross-bar 108 will form an angle relative to the vertically oriented post 104 or 106). Finally, while maintaining each post 104 and 106 in an essentially upright and plumb position (with the use of a level), each anchor/stabilizer 100 is attached to its corresponding post 104 and 106 by driving several screws through the holes 112 in plate 110 and into the post 104 and 106. When thus assembled, the cross-bars 108 essentially form legs that extend perpendicularly from each post 104 and 106 and provide additional stability to help maintain the sign 100 in an upright and plumb position over time.

As previously mentioned, the materials and dimensions of the anchor/stabilizer 100 can vary and be selected based on the size of the sign and the forces likely to be encountered at the installation site. For the current embodiment, for example, with a sign having two vertical posts and a display area of from about 9 to about 32 square feet, the cross-bar 108 can preferably be made of standard 1 inch steel angle iron and can be from about 24 to about 48 inches in length. While the illustrated embodiment illustrates the elongate support or cross-bar 108 as being an angle iron, any suitable shape having sufficient rigidity could be substituted, including, but not limited to, solid bars or rods, square tubing or other shapes or profiles. In addition, while the preferred material is metal, other suitable materials having suitable strength and other properties can be substituted.

In addition to the other factors identified above, the size and shape of the cross-bar 108 should preferably be selected so that its profile (once properly installed) is low enough to the ground that mowers and other grounds-keeping equipment can pass over the cross-bar 108 during routine maintenance without contacting or otherwise damaging the cross-bar 108. In the case described above, where the cross-bar 108 comprises an angle iron, the downwardly extending leg of the angle iron can also be forced into the surrounding soil by applying pressure to the top of the angle iron (e.g., by stepping on it or tapping with a hammer) before attaching the anchor/stabilizer 100 to the post.

Similarly, the size, thickness and material of plate 1100 can vary depending on the size of the sign, the forces likely to be encountered, and the width of the posts to which plate 110 will attach. In addition, the width of plate 110 can preferably be less than the width of the post to which it will attach. This is so that the plate 110 can be oriented at various angles relative to the post without extending beyond the sides of the post. For example, in the case where the current embodiment will be used with a sign that includes standard 4×4 posts (which measure approximately 3.5 inches wide in both transverse dimensions), the plate 110 can have dimensions of about 3 inches wide and about 4 inches tall.

With the current embodiment, plate 110 can be welded to cross-bar 108 and then the weld joint ground down to provide a substantially flat mounting surface for engaging the side of the post. However, anchor/stabilizer 100 could be produced through other manufacturing methods, such as casting, machining, etc., that would allow cross-bar 108 and plate 112 to be integrally formed from a single piece of material.

FIG. 2 illustrates another aspect of the invention. Another problem frequently encountered with temporary signs is damage that can be caused to the upright posts of the sign by grounds-keeping equipment, particularly line trimmers or "weed-eaters", during routine yard maintenance. While such damage rarely compromises the structural integrity of the sign, it can be unsightly also resulting in an undesirable appearance and/or commercial impression.

To prevent such damage, the sign anchor/stabilizer 200 can also include a sleeve or shield 214 that surrounds a portion of the post 204 or 206 adjacent to the ground. Sleeve/shield 214 can be pre-formed to closely conform to the shape of the posts. Sleeve/shield 214 can have one side that can be opened or separated, as shown in FIG. 2A, to allow it to be placed around the post, with the side that can be opened or separated for installation being positioned between the post and the anchor/stabilizer 200 before the anchor/stabilizer 200 is attached to the post. Once attached, the sleeve/shield 214 is securely held in place and helps prevent damage to the lower portion of the post. Here, again, the height of sleeve/shield 214 is selected based on the anticipated conditions, but can typically be from 3 to 6 inches in height. Sleeve/shield 214 can be made from any suitable material, including, but not limited to sheet metal, plastic or other suitable material that can hold up to repeated encounters with a line trimmer. In addition, the sleeve/shield can be adapted for use with any of the other anchor/stabilizer embodiments described herein.

Figure 3A:
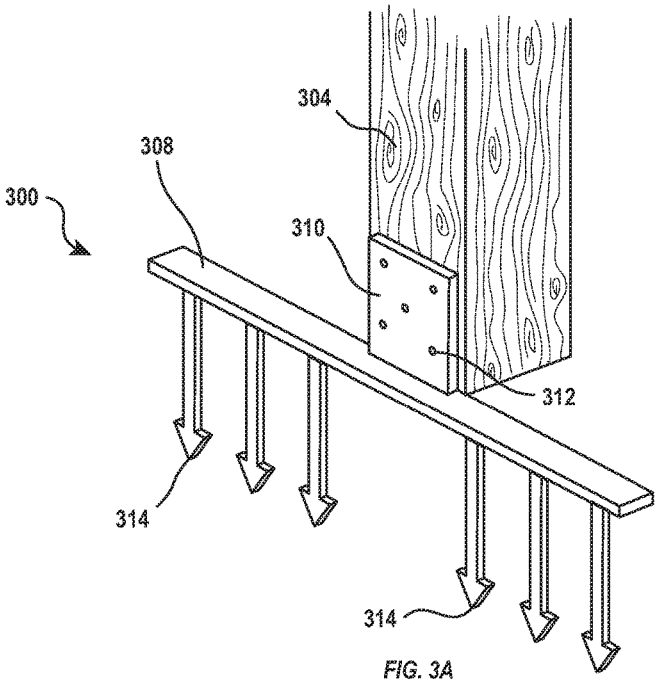
FIG. 3A is a perspective view of another embodiment of a yard sign anchor/stabilizer.
Figure 3B:
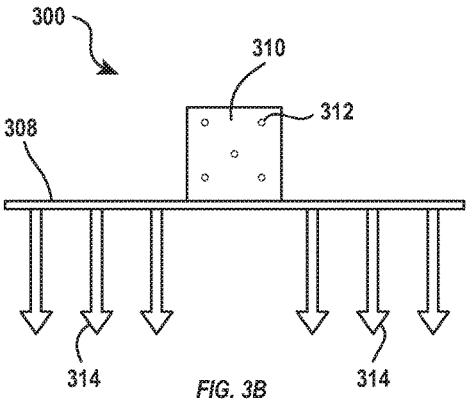
FIG. 3B is a side, plan view of the yard sign anchor/stabilizer of FIG. 3A.
Figure 3C:
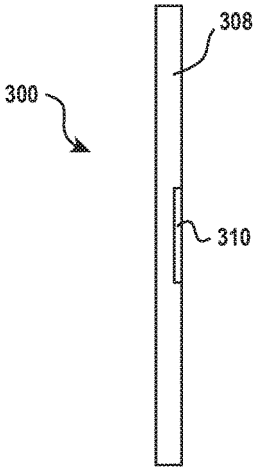
FIG. 3C is a top, plan view of the yard sign anchor/stabilizer of FIG. 3A.
Figure 4A:
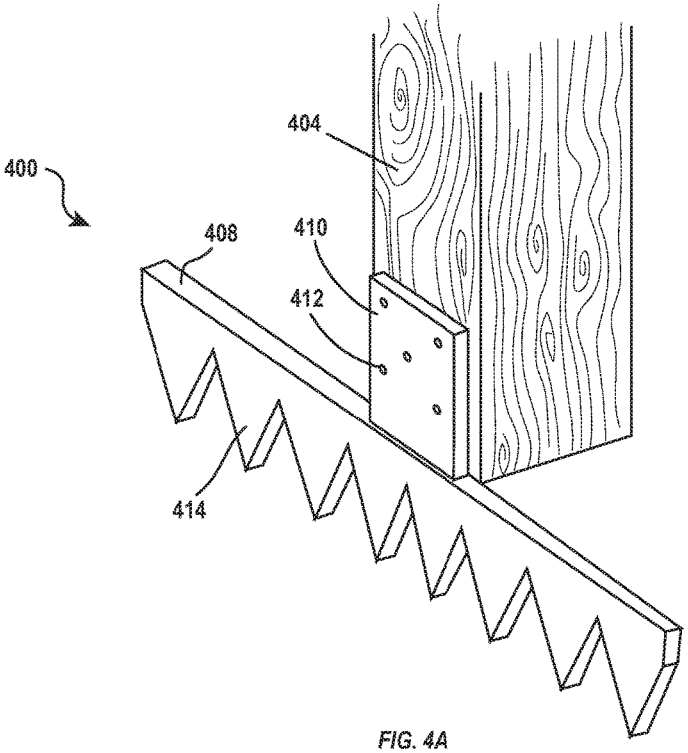
FIG. 4A is a perspective view of yet another embodiment of a yard sign anchor/stabilizer.
Figure 4B:
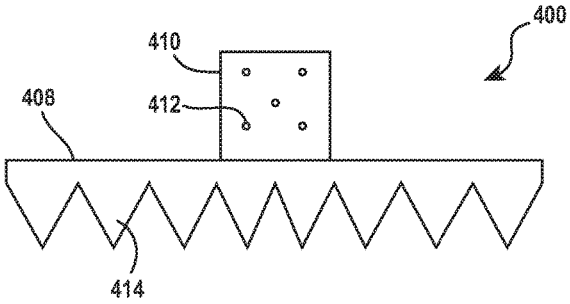
FIG. 4B is a side, plan view of the yard sign anchor/stabilizer of FIG. 4A.
Figure 4C:
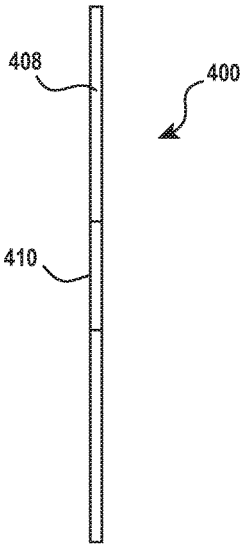
FIG. 4C is a top, plan view of the yard sign anchor/stabilizer of FIG. 4A.

FIGS. 3 and 4 show other embodiments similar to that shown and described in FIG. 1. Although FIGS. 3 and 4 show some additional variations, the embodiments illustrated and described below function and are assembled in a manner similar to that describe above. For example, the embodiment shown in FIG. 3 shows an anchor/stabilizer 300 that includes an elongate plate 308 with a plurality of stakes 314 extending from the bottom of the elongate plate 308, and a mounting plate 310 that extends from the top of elongate plate 308. With the anchor/stabilizer 300 positioned against the post 304 or 306 to which it will be attached, the stakes 314 can be forced into the ground adjacent to the post 304 or 306 and, with the post 304 or 306 held in a vertical and plumb position, the anchor/stabilizer 300 can then be attached to the post 304 or 306 with suitable fasteners.

Similarly, the embodiment shown in FIG. 4 can include an elongate plate 408 that can include a plurality of teeth 414 along its bottom portion and a mounting plate 410 attached to is upper surface. Here, again, with the anchor/stabilizer 400 positioned against the post 404 or 406 to which it will be attached, the teeth 414 can be forced into the ground adjacent to the post 404 or 406 and, with the post 404 or 406 held in a vertical and plumb position, the anchor/stabilizer 400 can then be attached to the post 404 or 406 with suitable fasteners. In other respects the embodiments shown in FIGS. 4 and 5 are similar to that described in relation to the embodiment shown in FIG. 1 and can accommodate the addition of the sleeve/shield as described and shown in FIG. 2.

Figure 5A:
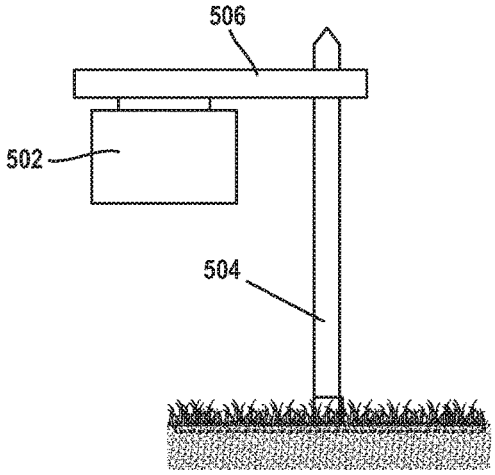
FIG. 5A is a view of another style of yard sign.
Figure 5B:
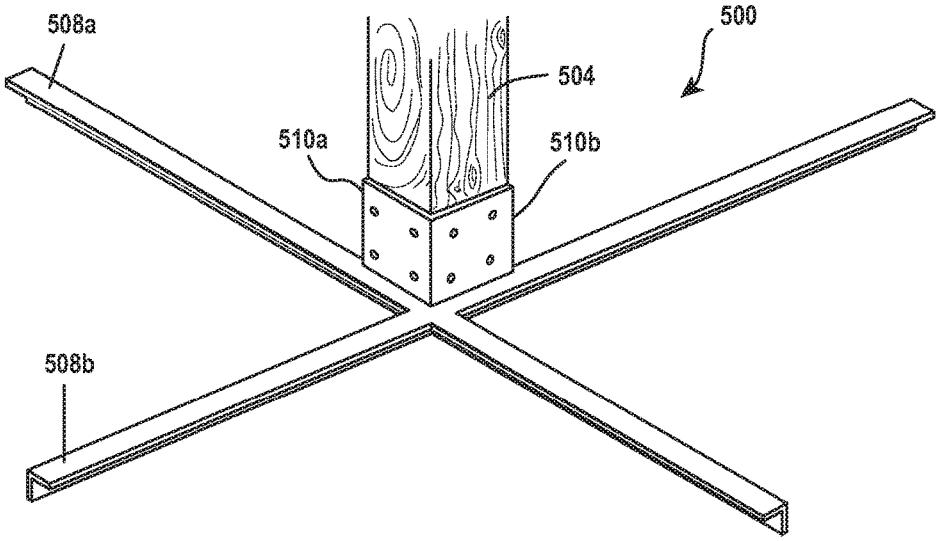
FIG. 5B is a perspective view of an embodiment of a yard sign anchor/stabilizer designed for use with a yard sign having a single vertical post.

Another common form of yard sign 502, which includes only a single upright post 504 and a horizontal cross-member 506, is illustrated in FIG. 5A. It will be appreciated that the cantilevered orientation of the horizontal cross-member 506 contributes additional forces that cause the sign 502 to bend or sag from the vertical over time. FIG. 5B illustrates yet another embodiment of an anchor/stabilizer 500 that is particularly useful in supporting and stabilizing such single-post signs 502. Anchor/stabilizer 500 is similar in many respects to the sign anchor/stabilizer illustrated and described in relation to FIG. 1, except that anchor/stabilizer 500 is designed to provide stability simultaneously in two directions, namely, side to side and front to back. Anchor/stabilizer 500 can include a pair of elongate supports or cross-bars 508*a* and 508*b* that are orientated at right angles. Anchor/stabilizer 500 can also include a pair of mounting plates 510*a* and 510*b* that are attached to a top surface of each of cross-bars 508*a* and 508*b*, respectively. Each of plates 510*a* and 510*b* include a plurality of holes to accommodate screws or other suitable fasteners for securely fastening anchor/stabilizer 500 to post 504.

Figure 5C:
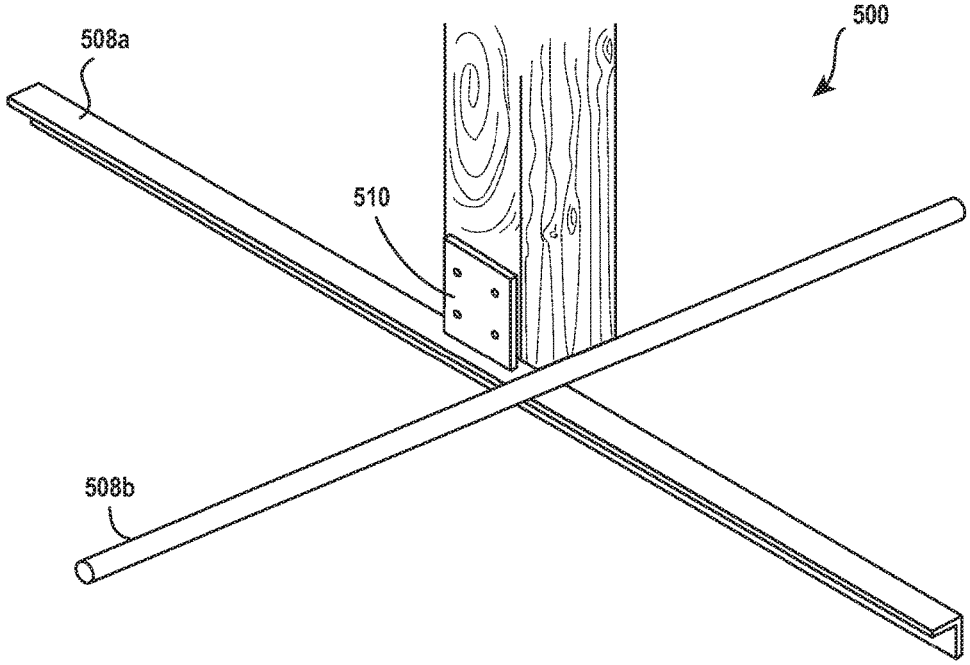
FIG. 5C is a perspective view of another embodiment of a yard sign anchor/stabilizer designed for use with a yard sign having a single vertical post.

FIG. 5C illustrates another variation of the embodiment shown in FIG. 5C that is further adapted for use on sloped ground. In this embodiment, anchor/stabilizer 500 can also include a pair of elongate supports or cross-bars 508*a* and 508*b*, but preferably includes only a single mounting plate 510. In addition, cross-bar 508*a* can be an angle iron, while cross-bar 508*b* can be a solid bar. This configuration provides additional flexibility in attaching anchor/stabilizer 500 to the post 504 while, at the same time, allowing both cross-bars 508*a* and 508*b* to closely contact the ground on sloping terrain.

Figure 6:
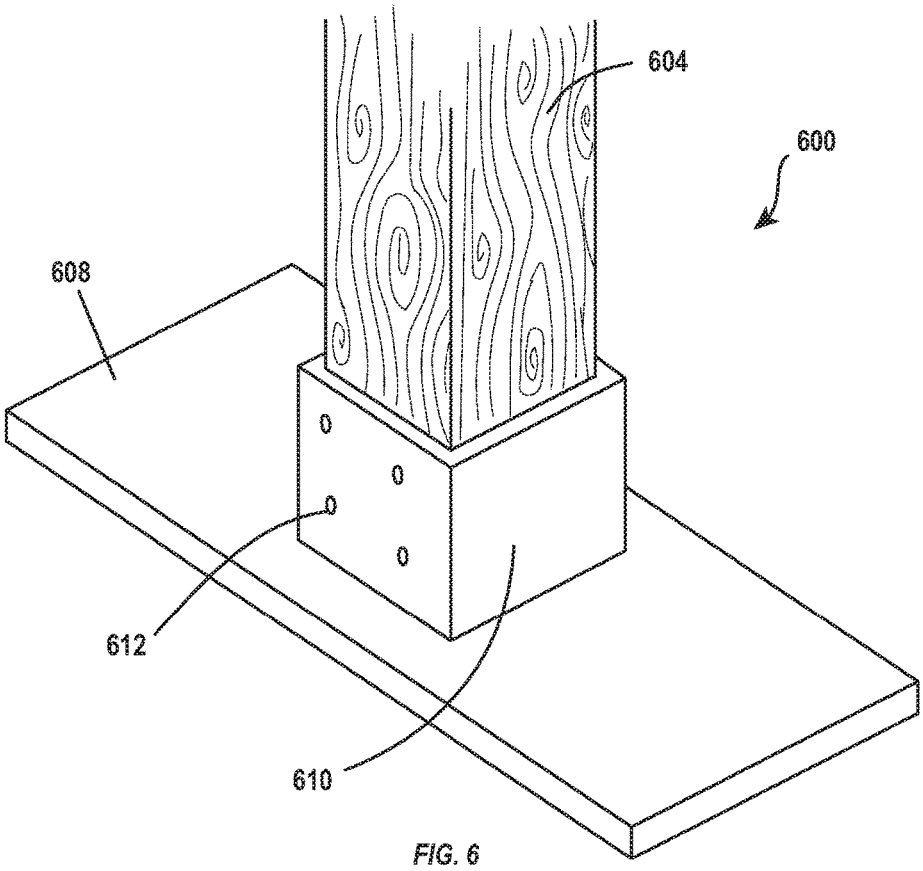
FIGS. 6-9 are perspective views of additional embodiments of yard sign anchor/stabilizers.

FIGS. 6-9 illustrate additional embodiments of anchor/stabilizers that can be used to provide additional support, but which are intended for use primarily on substantially level ground. For example, FIG. 6 illustrates an embodiment of an anchor stabilizer 600 that includes a support plate 608 and a collar 610 that extends vertically from the top surface of the support plate 608. The collar 610 is sized to receive a post 604 through a center opening in the collar 610. Collar 610 also includes a plurality of holes 612 for receiving screws or other suitable fasteners for securing anchor/stabilizer 600 to the post 604. With this embodiment, an anchor/stabilizer 600 is slid over the bottom of post 604 before the posts are placed in the ground. Once the sign is placed in the ground and the holes are back-filled and compacted, then the anchor/stabilizer 600 is slid down the post 604 and into contact with the ground. Finally, while maintaining the post 604 in an essentially upright and plumb position (with the use of a level), the anchor/stabilizer 600 is attached to by driving several screws through the holes 612 in collar 610 and into the post 604.

Figure 7:
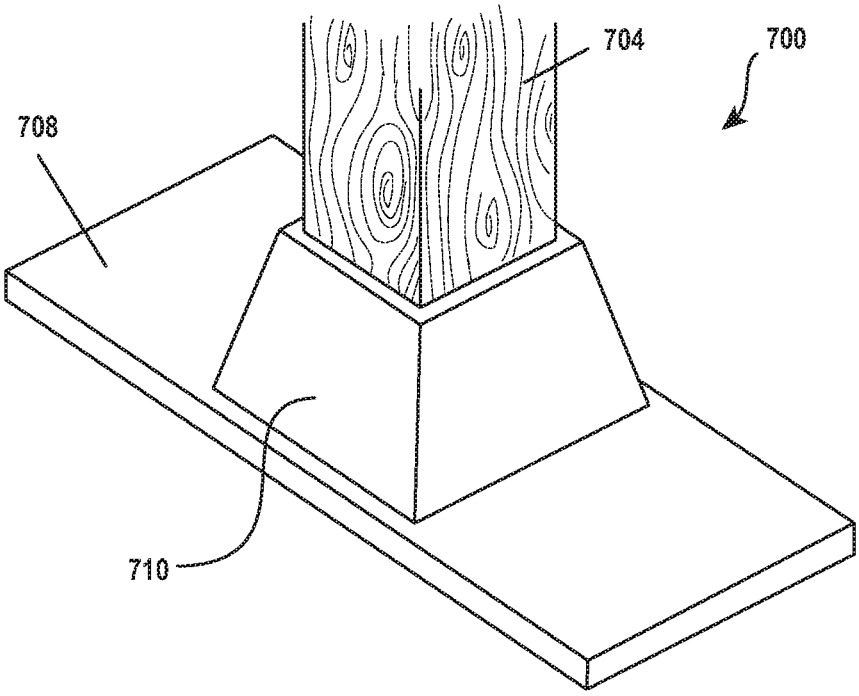

The anchor/stabilizer 700 shown in FIG. 7 is similar in many respects to the embodiment of FIG. 6, except that collar 710 can include sloping side walls to provide additional lateral support to post 704.

Figure 8:
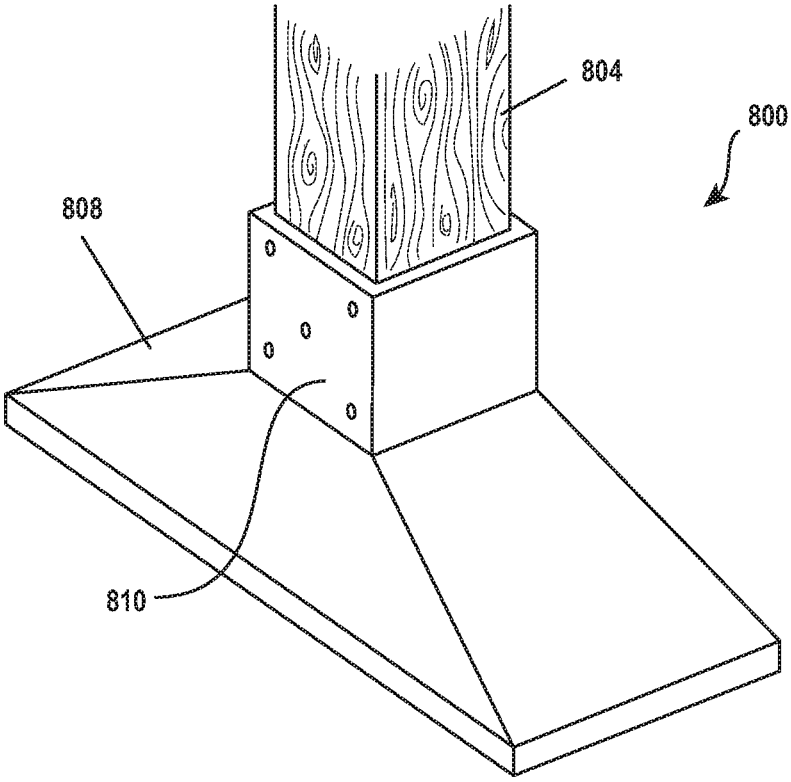

Similarly, the anchor/stabilizer 800 shown in FIG. 8 is similar in many respects to the embodiments of FIGS. 6 and 7, except that support plate 708 can include sloping side walls to provide additional lateral support to post 804.

Figure 9:
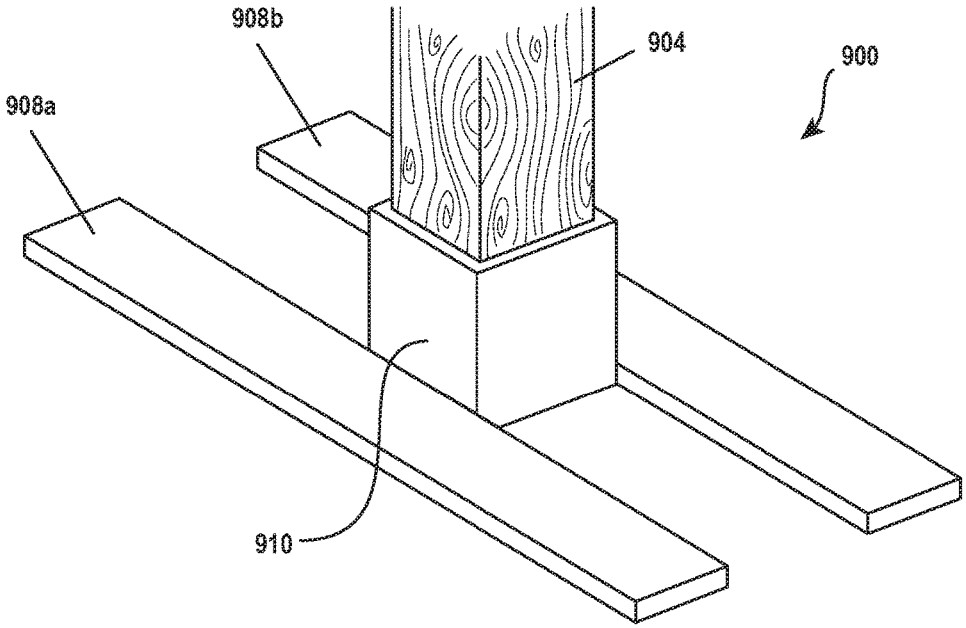

Finally, the anchor/stabilizer 900 shown in FIG. 9 is similar in many respects to the embodiment shown in FIG. 6, except that it can include a pair of support plates 908*a* and 908*b* that are positioned on either side of collar 910.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A device intended for use with a yard sign having at least one vertical post, the yard sign being supported by a lower portion of the post being buried in the ground, the device providing additional stability and support to assist in maintaining the sign in an essentially upright and plumb position over time, the device comprising:

an elongate support member comprising an angle iron, the angle iron having a horizontal leg and a vertical leg:

wherein the vertical leg is configured to extend downward into the soil, wherein the horizontal leg is configured to lay substantially flat with a low profile on top of the soil; and a mounting plate, wherein the mounting plate is rigidly connected to the elongate support member at an intermediate position along the elongate support member, wherein the vertical leg of the elongate support member and the mounting plate are coplanar and form a substantially flat surface for engaging and selective attachment to a side of the post; and wherein the mounting plate includes a plurality of holes for receiving fasteners for fastening the device to the side of post.

2. A device intended for use with a structure having at least one vertical post, the structure being supported at least in part by a lower portion of the post being buried in the ground, the device providing additional stability and support to assist in maintaining the post in an essentially upright and plumb position over time, the device comprising:

an elongate support member;

a sleeve shield at least partially surrounding the post; and a mounting plate, wherein the mounting plate is rigidly connected to the elongate support member at an intermediate position along the elongate support member, wherein the elongate support member and the mounting plate form a substantially flat surface for engaging and selective attachment to the sleeve shield; and wherein the mounting plate and the sleeve shield include a plurality of holes for receiving fasteners for fastening the device to the side of the post.

3. The device recited in claim 1, further comprising one or more stakes extending downward from the vertical leg of the angle iron.

4. The device recited in claim 3, wherein the one or more stakes comprise a barbed tip.

5. The device recited in claim 1, further comprising a plurality of teeth extending downward from the vertical leg of the angle iron.

6. The device recited in claim 2, the sleeve shield comprising at least one side that can be opened for installation of the sleeve shield around the post.

7. The device recited in claim 6, wherein the at least one side of the sleeve shield that can be opened is positioned between the post and the mounting plate.

8. The device recited in claim 2, wherein the sleeve shield is about 3 to 6 inches in height.

9. A device intended for use with a structure having at least one vertical post, the structure being supported at least in part by a lower portion of the post being buried in the ground, the device providing additional stability and support to assist in maintaining the post in an essentially upright and plumb position over time, the device comprising:

a first elongate support member comprising a first angle iron and a second angle iron disposed substantially perpendicular to the first angle iron, each of the first and second angle irons having a horizontal leg and a vertical leg;

wherein the vertical legs are configured to extend downward into the soil, wherein the horizontal legs are configured to lay substantially flat with a low profile on top of the soil; and a mounting plate, wherein the mounting plate is rigidly connected to the first elongate support member at an intermediate position along the first elongate support member, wherein the vertical leg of the first elongate support member and the mounting plate are coplanar and form a substantially flat surface for engaging and selective attachment to the post; and wherein the mounting plate includes a plurality of holes for receiving fasteners for fastening the device to the post.

10. The device recited in claim 9, further comprising one or more stakes extending downward from the vertical legs of the first and second angle irons.

11. The device recited in claim 10, wherein the one or more stakes comprise a barbed tip.

12. The device recited in claim 9, further comprising a plurality of teeth extending downward from the vertical legs of the first and second angle irons.

13. The device recited in claim 9, further comprising a sleeve shield at least partially surrounding the post, and wherein the support member is fastened to the post through the sleeve shield.

14. The device recited in claim 13, the sleeve shield comprising at least one side that can be opened for installation of the sleeve shield around the post.

15. The device recited in claim 14, wherein the at least one side of the sleeve shield that can be opened is positioned between the post and the mounting plate.

16. The device recited in claim 13, wherein the sleeve shield is about 3 to 6 inches in height.

* * * * *